United States Patent [19]

Holt et al.

[11] Patent Number: 4,933,241

[45] Date of Patent: Jun. 12, 1990

[54] PROCESSES FOR FORMING EXOERGIC STRUCTURES WITH THE USE OF A PLASMA AND FOR PRODUCING DENSE REFRACTORY BODIES OF ARBITRARY SHAPE THEREFROM

[75] Inventors: J. Birch Holt, San Jose, Calif.; Michael D. Kelly, West Alexandria, Ohio

[73] Assignee: United States Department of Energy, Washington, D.C.

[21] Appl. No.: 311,795

[22] Filed: Feb. 17, 1989

Related U.S. Application Data

[63] Continuation-in-part of Ser. No. 55,219, May 29, 1987, Pat. No. 4,806,384.

[51] Int. Cl.[5] ..... B32B 9/00; B05D 1/00

[52] U.S. Cl. ..... 428/689; 428/697; 427/34; 427/423; 427/224; 427/377; 427/427

[58] Field of Search ..... 427/34, 423, 224, 377, 427/427; 428/689, 697

[56] References Cited

U.S. PATENT DOCUMENTS

| | | | |
|---|---|---|---|
| 2,943,951 | 7/1960 | Haglund et al. | 427/423 |
| 3,344,210 | 9/1967 | Silvia | 264/3 |
| 3,387,110 | 6/1968 | Wendler et al. | 219/76 |
| 3,513,044 | 5/1970 | Ishibashi | 149/87 |
| 3,523,840 | 8/1970 | Bedell | 149/19.1 |
| 3,591,759 | 7/1971 | Stund | 219/76 |
| 3,676,638 | 7/1972 | Stund | 219/121 P |
| 3,734,983 | 5/1973 | Forsten et al. | 264/3 C |
| 3,766,820 | 10/1973 | Forster et al. | 86/23 |
| 4,092,383 | 5/1978 | Reed, Jr. | 264/3 C |
| 4,121,083 | 10/1978 | Smith | 219/76.16 |
| 4,124,663 | 11/1978 | Brumley et al. | 264/30 |
| 4,146,654 | 3/1979 | Guyonset | 427/34 |
| 4,202,641 | 5/1980 | Yurasho, Jr. | 427/423 |
| 4,445,021 | 4/1984 | Irons et al. | 219/121 PM |

*Primary Examiner*—Stanley Silverman
*Attorney, Agent, or Firm*—Leona Lauder; L. E. Carnahan; William R. Moser

[57] ABSTRACT

Plasma spraying methods of forming exoergic structures and coatings, as well as exoergic structures produced by such methods, are provided. The methods include the plasma spraying of reactive exoergic materials that are capable of sustaining a combustion synthesis reaction onto a flat substrate or into molds of arbitrary shape and igniting said plasma sprayed materials, either under an inert gas pressure or not, to form refractory materials of varying densities and of varying shapes.

23 Claims, 5 Drawing Sheets

DENSE PARTS RESULT FROM COMBUSTION SYNTHESIS OF PLASMA FORMED Ti 2B

DENSITY 98% UNREACTED

DENSITY 71% PRESSURE 1 ATM

DENSITY 90% PRESSURE 1000 ATM

ADDITION OF Fe DURING PLASMA FORMING RESULTED IN COMPARABLE DENSITIES

DENSITY 90% UNREACTED

DENSITY 62% 1 ATM

DENSITY 84% 1000 ATM

PROCESSES FOR FORMING EXOERGIC STRUCTURES WITH THE USE OF A PLASMA AND FOR PRODUCING DENSE REFRACTORY BODIES OF ARBITRARY SHAPE THEREFROM

The United States Government has rights in this invention pursuant to Contract No. W-7405-ENG-48 between the U.S. Department of Energy and the University of California, for the operation of Lawrence Livermore National Laboratory.

This application is a continuation-in-part of U.S. Ser. No. 055,219 filed May 29, 1987, which is pending at the time of filing this application, but about to issue as U.S. Pat. No. 4,806,384.

BACKGROUND OF THE INVENTION

This invention relates to methods of forming an exoergic structure or coating from reactive exoergic materials and to exoergic structures and coatings produced by such methods. This invention further relates to the formation of said exoergic structures and coatings in arbitrary shapes by plasma spraying upon a suitable substrate. Still further, this invention relates to the plasma spraying of reactants, which are capable of sustaining a combustion synthesis reaction, into exoergic structures or coatings and igniting said plasma sprayed reactants either under pressure or not under pressure to form refractory materials of varying densities.

Exoergic materials and structures produced therefrom have long been known in the art. As used herein, "exoergic materials" are materials which react to release relatively large quantities of energy. Such materials contain all of the components necessary to sustain an exothermic reaction, in and of themselves. Thus, such materials can contain an oxidizing agent and an agent to be oxidized. Such materials can be ignited by suitable means to produce a conventional, self-propagating exothermic reaction and have applications as "one-shot" chemical heat sources.

Other exoergic materials, if the amount of exothermic heat released is sufficient, can be ignited in a nonconventional combustion mode known as "self-propagatory high temperature synthesis" (SHS) or combustion synthesis. Preferably, such a combustion synthesis is carried out under pressure and results in a useful product, preferably a dense refractory material.

The amount of exothermic heat released depends upon the particular chemical system. For example, the heat of formation of silicon carbide (SiC) from silicon and carbon powders is 300 cal/g; whereas the heat of formation for titanium diboride ($TiB_2$) from titanium and boron powders is 1200 cal/g. When the reaction has sufficient chemical energy to be carried out by combustion synthesis, the process is characterized by a rapidly moving combustion front and self-generated high temperatures in the product phase.

Exoergic materials have been formed into shapes, for instance, by pressing into pellets, rings, rods or cups for use in welding applications and the like. However, many useful configurations cannot be readily achieved by pressure-forming powder mixtures because of die-shape restrictions. For example, thin-walled shapes cannot be pressed because large length-to-diameter ratios result in nonuniform densities. Accordingly, known methods of producing exoergic structures are deficient, and there has been a continuing need for improvement.

Deposition of powdered materials onto substrates by the use of plasma guns has been known for many years. Exemplary patents are U.S. Pat. Nos.3,387,110; 3,591,759; 3,676,638; 4,121,083; and 4,146,654. It is to be noted that many of these patents relate to plasma flame-spraying which is entirely nonanalogous to plasma spraying per se.

Although such plasma spraying techniques exist, conventional wisdom in the art dictates that such techniques cannot be used in the formation of exoergic structures since exoergic materials would be expected to react violently, releasing large quantities of energy, in the plasma. In one aspect, this invention thus relates to methods of forming exoergic structures and coatings by plasma spraying exoergic materials without chemically reacting said materials.

This application further relates to a method of producing dense refractory materials by combustion synthesizing the plasma sprayed appropriate exoergic materials capable of sustaining a combustion synthesis reaction. As indicated above, materials having sufficiently high heats of formation can be synthesized in a combustion synthesis process characterized by a combustion wave which, upon ignition, spontaneously propagates throughout the reactants, converting them into products.

The use of a combustion reaction to synthesize a refractory material was first considered by Walton et al. [*J. Am. Ceram. Soc.*, 42(1): 40–49 (1959)] who produced a composite ceramic/metallic material using thermite reactions. In the late 1960's, A. G. Merzhanov and his colleagues began work on self-propagating combustion reactions which led to the development of a process which they called "self-propagating high temperature synthesis" (SHS). [See Merzhanov et al., *Dokl. Chem.*, 204 (2): 429–32 (1972): Crider, *Ceram. Eng. Sci. Proc.*, 3 (9–10): 538–554 (1982).]

Self-propagating high temperature synthesis (SHS), alternatively and more simply termed combustion synthesis, is an efficient and economical process of producing refractory materials. [See for general background on combustion synthesis reactions: Holt, *MRS Bulletin*, pp. 60–64 (Oct. 1/Nov. 15, 1987); and Munir, *Am. Ceram. Bulletin*, 67 (2): 342–349 (Feb. 1988).] The combustion reaction is initiated by either heating a small region of the starting materials to ignition temperature whereupon the combustion wave advances throughout the materials, or by bringing the entire compact of starting materials up to the ignition temperature whereupon combustion occurs simultaneously throughout the sample in a thermal explosion.

In the synthesis of refractory materials by conventional methods, the chemical reaction is initiated and carried to completion by heat from an external source such as a furnace. Usually, the heating rate is purposely kept low to avoid large temperature excursions caused by the high heats of reaction. Refractory materials prepared by such conventional methods are relatively expensive due to the high cost of energy and equipment. In the combustion synthesis process, however, after ignition has occurred, the rest of the sample is subsequently heated by the heat liberated by the reaction without the input of further energy. As a result, the power needed is much lower, and expensive equipment, such as high temperature furnaces, is not required.

Advantages of combustion synthesis include: (1) higher purity of products; (2) low energy requirements; and (3) relative simplicity of the process. [Munir, supra at 342.] However, one of the major problems of combustion synthesis is that the products are "generally porous, with a sponge-like appearance." [Yamada et al., *Am. Ceram. Soc.*, 64 (2): 319–321 at 319 (Feb. 1985).] The porosity is caused by three basic factors: (1) the molar volume change inherent in the combustion synthesis reaction; (2) the porosity present in the unreacted sample; and (3) adsorbed gases which are present on the reactant powders.

Because of the porosity of the products of combustion synthesis, the majority of the typical materials produced are powders or porous (40–60%) compacts. If dense materials are desired, the powders or compacts then must undergo some type of densification process, such as sintering or hot pressing. The ideal production process for producing dense SHS materials would combine the synthesis and densification steps into a one-step process.

The present invention solves the problem of porosity of combustion synthesis products by plasma spraying the reactant powders onto a suitable substrate to form a fully dense, unreacted body or coating. Because the plasma spraying is a high temperature operation, any absorbed gases are removed in the hot plasma. The resulting structure comprises a fully dense, homogeneous mixture of the reactants. Rapid quenching of the powders upon impact, noncontact in the plasma flame, and short dwell times in the plasma, prevent the occurrence of a chemical reaction between or among the reactants. Both reactants melt in the plasma prior to deposition. Therefore, this aspect of the invention obviates two sources of porosity as described above for combustion synthesis.

The plasma-formed body can take on various near net and net shapes from both simple to complex, ranging from flat or cylindrical compacts to hemispheres, spheres or other more complicated shapes created by the design of a mandrel or mold. As indicated above the plasma-formed materials may be monolithic structures or single or multi-layered coatings.

The plasma-sprayed fully dense reactant materials are then ignited preferably under an inert gas pressure whereupon a combustion wave rapidly sweeps through the materials transforming them into the product phase. This inventive process differs from conventional (non-SHS) means of producing dense refractory materials of various shapes, such as hot-isostatic-pressing for the following reasons, among others: (1) the synthesis of the product occurs during combustion; (2) there is no need for a high temperature furnace since the chemical energy released in the process supplies the heat that is necessary for densifying the product; and (3) a barrier material, such as a metal canister or glass envelope, is not required since the reactant materials are fully dense and self-contained.

Other methods of densifying combustion synthesis products have been used and include the following approaches: (1) the simultaneous synthesis and sintering of the product; (2) the application of pressure during (or shortly after) the passage of the combustion front; and (3) the use of a liquid phase in the combustion process to promote the formation of dense bodies. [*Munir, Am. Ceram. Bulletin,* 67(2): 342–349 at 347 (Feb. 1988).] However, a unique and salient aspect of this invention is that not only do the methods result in dense refractory materials, but also the materials are created in the shape required for the intended use. This feature is especially important in that dense refractory materials are very hard (for example, $TiB_2$ has a hardness comparable to diamond) and are therefore difficult to grind to the requisite shape. The methods of this invention result in refractory materials of near net or net shape.

The combustion synthesis of plasma-formed materials not only minimizes the porosity of the products, but also promotes their uniformity. Other advantages of said processes will be evident from the examples, claims and description below.

SUMMARY OF THE INVENTION

It is accordingly an object of this invention to provide a method for producing exoergic structures and coatings from exoergic materials by the use of a plasma spray wherein the exoergic materials are not reacted in the plasma. It is another object of this invention to produce such exoergic structures and coatings of various shapes. It is a further object of this invention to provide exoergic structures and coatings made by such processes. It is still further an object of this invention to make refractory materials of varying densities and shapes, preferably dense and preferably of net or near net shape.

Upon further study of the specification and appended claims, further objects and advantages of this invention will become apparent to those skilled in the art.

According to one aspect of this invention, the foregoing objects are obtained by providing a method of forming an exoergic structure or coating from reactive exoergic materials comprising:

(a) introducing an oxygen-free plasma-forming gas into a plasma spray;
(b) introducing said reactive exoergic materials in finely divided particulate form into said plasma spray directed toward, but not impinging on, a substrate;
(c) melting without chemically reacting the reactive exoergic materials in the plasma; and
(d) impinging said molten reactive exoergic materials on said substrate to form a reactive exoergic shape which corresponds to the shape of said substrate.

According to another aspect of this invention, the objects are obtained wherein the reactive exoergic materials of the above-described method are capable of sustaining a combustion synthesis reaction and wherein the method further comprises the step of:

(e) igniting said reactive exoergic shape to initiate a combustion synthesis reaction. Said ignition and combustion synthesis reaction are preferably carried out in an inert gas. The resulting combustion synthesis product is a refractory material which is preferably uniform, but which can vary in density. If high density refractory materials are desired the combustion synthesis reaction is carried out under an inert gas pressure.

The refractory materials produced by the processes of this invention preferably comprise one or more ceramic phases, an intermetallic phase, or a composite material comprising a ceramic and intermetallic and/or metallic phases. A preferred composite material is that comprising $TiB_2$ and Fe.

Preferred refractory materials include borides, sulfides, selenides, hydrides and silicides. More preferred are borides that are selected from the group consisting of aluminum, chromium, titanium, tantalum, hafnium, vanadium, magnesium, tungsten, zirconium, molybdenum and niobium borides. Further preferred are the borides selected from the group consisting of titanium, zirconium, hafnium and niobium borides. Still further preferred are the titanium borides, TiB and $TiB_2$, and most preferred is $TiB_2$.

BRIEF DESCRIPTION OF THE DRAWINGS

Various other objects, features, and attendant advantages of the present invention will be more fully appreciated as the same becomes better understood when considered in connection with the accompanying drawings, in which like reference characters designate the same or similar parts throughout the several views, and wherein.

DETAILED DISCUSSION

Definitions

The term "intermetallic" is herein defined to be a compound composed of two or more metals.

The term "dense" is used herein to denote a property of a material having a density which is greater than about 85% of theoretical, preferably greater than 90% of theoretical, more preferably greater than 95%, and still more preferably greater than 97% of theoretical and even more preferably greater than 99% of theoretical, wherein density is mass per unit volume. "Preferably" as herein used to define "dense" is used in a relative sense depending upon the particular application for which the refractory material is being prepared. In a general sense, materials that are less than approximately 90–95% dense have interconnecting porosity which can be open to the surface; such interconnecting and perhaps open porosity may be appropriate for certain insulative materials, but would not be appropriate for applications requiring a gas tight material.

The term "diluent" is used herein to denote a substance that is added to the reagents in the processes of this invention to drop the combustion temperature of the reaction; said "diluent" does not therefore produce heat during the combustion reaction; that is, it is effectively inert in the processes of this invention.

The term "dopant" is herein used to denote a substance added in small quantities (that is, approximately less than 5% by weight of the product) to the reagents in the processes of this invention to alter the properties of the product and/or the parameters of the process.

"Arbitrary shape" is herein defined to mean any useful shape or structure, whether free-standing, a single or multilayered coating, or otherwise attached or appended, removably or irremovably, to a substrate, which is in various forms, whether symmetrical or unsymmetrical, which forms include but are not limited to spheres, hemispheres, rectangles, oblongs, ellipses and specific forms required for cutting tools, engine parts, structural components, injection nozzles and other useful parts.

Plasma Spraying

Figure 1:
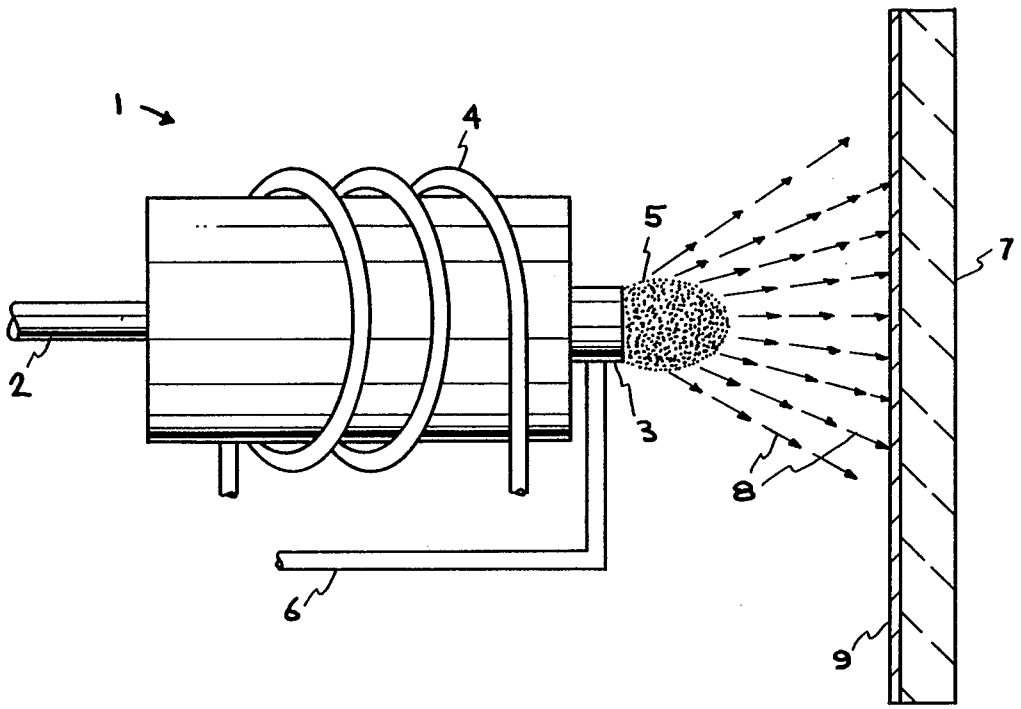
FIG. 1 is a schematic representation of a system for practicing the method of this invention.

In the system of FIG. 1, a plasma spray gun, designated generally as 1, is employed. The gun includes an inlet generally designated as 2 for a plasma-forming gas and an outlet generally designated as 3. The outlet comprises a plasma spray outlet which is fully conventional. The plasma spray gun includes fully conventional means for subjecting the plasma-forming gas to an amount of energy sufficient to form a plasma. This is accomplished by the use of fully conventional electrodes (not shown) and/or a radio-frequency coil 4. The electrodes are preferably positioned such that one is positioned downstream in the region of gas flow and the other is positioned upstream therein. When the plasma-forming gas is subjected to sufficient energy to form a plasma, the plasma exits the nozzle of the plasma spray gun and forms a plasma spray region 5. Reactive exoergic material can be introduced anywhere in the gas flow, e.g., at the inlet 2, etc. Preferably, the exoergic material is introduced in the plasma spray region at 6 by suitable means, e.g., a powder feed nozzle (not shown). The substrate or target 7 is positioned downstream of the plasma spray region.

In operation, suitable plasma-forming gas is introduced into the inlet of the plasma spray gun and is passed through the gun until it exits the plasma spray nozzle. The electrodes and/or radio-frequency coil are energized to initiate the plasma formation and form the plasma spray region. Exoergic material in finely divided particulate form is then introduced into the plasma spray region. In this region, the exoergic material becomes molten without chemically reacting and is propelled toward the substrate by the plasma flow. After exiting the plasma flow region, the molten particles 8 continue toward the substrate as a result of inertia and gas flow until they impinge on the substrate and solidify. The solidified particles 9 form a self-supporting, exoergic structure.

In the first aspect of this invention that does not involve combustion synthesis, any reactive exoergic material can be employed. Pyrotechnic or thermite materials are preferred therefor. Suitable materials include mixtures of $Fe_2O_3$ and Mg, $Fe_2O_3$ and Al, Zr and CuO, Zr and $Fe_2O_3$, Mg and chromium oxides, Al and chromium oxides, Zr and chromium oxides, and NiO and Al. Especially preferred are mixtures of aluminum and $Fe_2O_3$, mixtures of aluminum and $Cu_2O$, and mixtures of titanium and boron. Preferred particle sizes are in the range of from 220 to 325 mesh. Feed rates of such powders are typically 40–60 grams per minute, preferably 45–48 grams per minute.

In the second aspect of this invention wherein the plasma sprayed reactive exoergic materials are ignited to initiate a combustion synthesis reaction, only materials that are capable of sustaining a combustion synthesis reaction resulting in a useful product are preferred. Pyrotechnic materials would not be preferred for this aspect of the invention. As outlined above in the Summary of the Invention, preferred refractory materials produced according to this invention include ceramics, intermetallics, and composite materials of ceramic and intermetallic and/or metallic phases. A preferred composite material is $TiB_2$ and Fe. Also preferred are borides, sulfides, selenides, hydrides and silicides. Especially preferred are the following refractory materials:

| Borides | Silicides | Sulfides | Selenides |
|---|---|---|---|
| $AlB_2$ | CrSi | $WS_2$ | $WSe_2$ |
| CrB | $Cr_5Si_3$ | MgS | ZrSe |
| $CrB_2$ | $WSi_2$ | $MoS_2$ | $MoSe_2$ |
| VB | $W_5Si_3$ | $NbS_2$ | $NbSe_2$ |
| $VB_2$ | ZrSi | $TaS_2$ | $TaSe_2$ |
| $HfB_2$ | $ZrSi_2$ | | $TiSe_2$ |
| WB | $MoSi_2$ | | |
| $WB_2$ | $Mo_3Si$ | | |
| $W_2B$ | $NiSi_2$ | | |
| $W_2B_4$ | $TaSi_2$ | | |
| $MgB_2$ | TiSi | | |
| $MgB_4$ | $TiSi_2$ | | |
| $MgB_6$ | $TiSi_3$ | | |
| ZrB | $Ti_5Si_3$ | | |
| $ZrB_2$ | | | |
| MoB | | | |
| $Mo_2B$ | | | |
| $Mo_2B_5$ | | | |
| NbB | | | |
| $NbB_2$ | | | |
| TaB | | | |
| TiB | | | |
| $TiB_2$ | | | |

Also preferred refractory materials produced according to this invention include AlCo, AlNi, NbGe, $Nb_5Ge_3$, $NbAl_3$, TiNi and $TiNi_2$.

In general, reactive exoergic materials (for example, titanium and boron powders) that are capable of sustaining a combustion synthesis reaction are more difficult to melt in the plasma spray and require a lower feed rate which is preferably from about 20–40 grams per minute, preferably 20–30 grams per minute.

Suitable plasma-forming gases include argon and helium and admixtures of argon and hydrogen, most preferably plain argon. Oxidizing gases such as oxygen are not acceptable. Argon is a preferred plasma-forming gas. Gas feed rates are typically 40–60 cubic feet per hour.

The electrodes of the plasma torch require 350–800 amperes, preferably 600–800 amperes, at 24–58 volts. The temperature of the plasma is typically 15,000°–30,000° C. In this aspect of the invention the total system can be in an ambient pressure environment or in a slight vacuum environment.

The particles are typically fed into the hot region of the plasma. The powders melt in the plasma without any apparent chemical reaction and are transported by the gas flow in the plasma onto a target substrate which preferably is from about 3 to 10, more preferably about 9 inches from the edge of the plasma. Upon contact with the relatively cool surface of the target substrate, the molten powders very rapidly solidify to a dense structure. Although the known reaction ignition temperatures of the above-identified exoergic mixtures are lower than either the typical temperature of the plasma or the known melting points of the constituents of the mixtures, no reaction occurs because the dwell time of the powders in the plasma region is extremely short. Typical dwell times are on the order of a few microseconds, for instance not more than 500 microseconds. The dwell times must be long enough for the powders to melt but short enough so that no reaction occurs. Preferably, the plasma conditions are such that minimum particle-to-particle contact occurs, which contributes to the melting of the powder without chemical reaction.

Thin-walled, rigid, high-density exoergic structures of various geometries result. Typical wall thicknesses of the resulting structures are 0.040 inch, although wall thicknesses can range from a few thousandths to several inches.

The substrate can be formed of any suitable material. Particularly suitable are graphite and polytetrahalogenated compounds, e.g., polytetrahaloethylene (teflon) as well as stainless steel. The choice of shapes of the substrate is unlimited. Thus, targets can be in the form of flat plates, spheres, or any other shape. The orientation of the target in relation to a conventional argon plasma device is shown in FIG. 1. The mildness of the process has been demonstrated by plasma spraying powders onto an empty egg shell to produce a satisfactory structure of corresponding shape.

The target substrate can be readily separated from the fused structure so that the exoergic structure or coating can be isolated for later use. Alternatively, the exoergic material can be left on the substrate as an integral part. Such a composite is particularly suitable as a welding composite which can be conventionally ignited at a later time to cause joining by thermitic fusion.

In addition, the surface of the exoergic structure can be plasma sprayed with insulative and protective coatings. An insulator such as $ZrO_2$ can be used to direct the heat flow during the thermitic reaction, and various metals can be applied as protective coatings.

Figure 2:
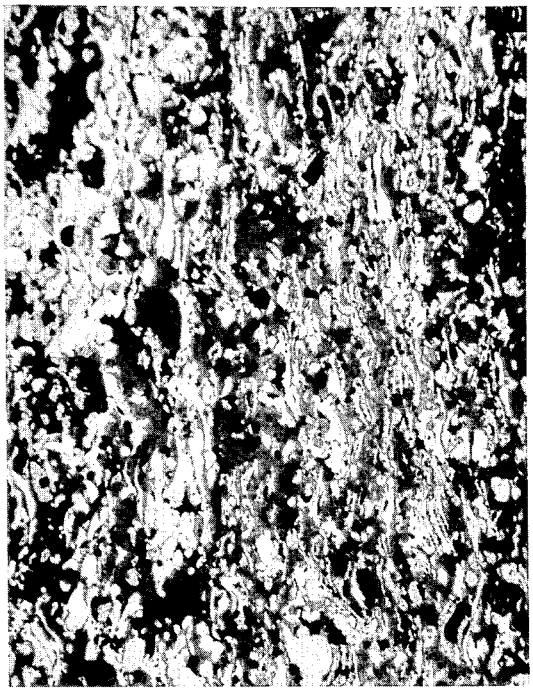
FIG. 2 discloses the microstructure of a typical plasma-formed part formed by a process of this invention.

The microstructure of a typical plasma-formed part is shown in FIG. 2. The interconnecting matrix resulted when molten Al and $Fe_2O_3$ particles hit the target and solidified. The white Al stringers interconnecting with the dark $Fe_2O_3$ stringers form a strong, continuous laminar matrix.

Figure 3:
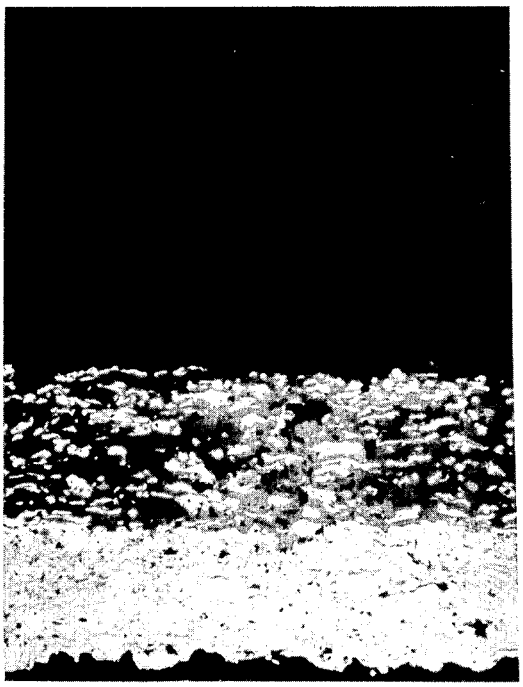
FIG. 3 shows the cross-section of a plasma-formed $Al/Fe_2O_3$ thermite sandwiched between a layer of $ZrO_2$ on the top and a layer of 304 stainless steel on the bottom.

In addition to $ZrO_2$, metals can also be plasma sprayed on the surface of the exoergic structure to form a protective coating. Additionally, the powders can be diluted with a diluent, e.g., $ZrO_2$. The micrograph in FIG. 3 shows the cross-section of a plasma-formed $Al/Fe_2O_3$ thermite sandwiched between a layer of $ZrO_2$ on the top and a layer of 304 stainless steel on the bottom. A continuous, uniform interface can be seen in this micrograph. Demonstrations have shown that thermite can be plasma formed to any desired shape, and coated for protection or for heat flow control.

Combustion Synthesis of Plasma Sprayed Materials

The aspect of this invention concerning the combustion synthesis of the plasma sprayed reactive exoergic materials comprises the simultaneous synthesis and densification of the refractory product into a near-net or net shape. Initially, as outlined according to the parameters above, the materials, for example, Ti and B, are plasma sprayed in appropriate stoichiometric amounts into any arbitrary, desired shape or coating. The resulting exoergic structure, comprising the unreacted exoergic materials, for example, the unreacted Ti and B that now are a plasma sprayed mixture of the desired shape, have a low porosity (about 1% to 10%). When such shapes or structures are ignited, for example, with a tungsten coil, a refractory material of the desired shape is prepared. Preferably, to prevent oxidation of the reactants and consequently to obtain products which are highly pure, the ignition and combustion synthesis are carried out in an inert gas, preferably argon.

If a dense refractory material is desired, for example, that is, about or greater than 85% dense, preferably greater than 90% dense, more preferably greater than 95% dense, still more preferably greater than 97% dense, the ignition of the plasma sprayed materials would be performed under an inert gas pressure wherein, in general, the higher the gas pressure, the more dense the product. Preferred pressures would be greater than 1 atm and less than about 4000 atm, more preferably in the range of from about 500 atmospheres (atm) to about 4000 atm, still more preferably from about 1000 atm to about 3000 atm, and even more preferably from about 1500 atm to about 2500 atm. For a particular chemical system, a preferred pressure range could be found within such ranges if a fully dense product, that is, greater than 99% dense, is desired.

The inert gas used for applying pressure in a pressure vessel such as an autoclave would include He, Ne and Ar, preferably argon.

The source of ignition for the combustion synthesis processes of this invention is not critical. Any source providing sufficient energy for ignition would be suitable. Exemplary methods include sources such as laser beams, resistance heating coils, focused high intensity radiation lamps, electric arcs or matches, solar energy, thermite pellets among other sources. A tungsten coil is a preferred ignition means.

The nature and composition of the product phases can be controlled by varying the ratios of the starting reagents, the level of inert gas pressure, by adding diluents and/or dopants, and by other methods apparent to those of ordinary skill in the art from the instant disclosure. By varying the combustion synthesis parameters, the properties of the product can be tailored to meet specific application needs.

Applications of the refractory materials of arbitrary shape produced according to the methods of this invention include their use as cutting tools, wear parts, electrodes of different shape, high temperature crucibles, armor, injection nozzles for coal-fired diesel engines, structural components, among other uses. Some uses to which the refractory materials produced according to this invention can be applied, may not demand as high a density as others. For example, materials used for filters, industrial foams, insulation, and crucibles, may not be required to be as dense as materials used for armor or abrasive and wear resistant materials. Therefore, the use to which the refractory material is to be applied can be determinative of the conditions of synthesis that would be optimal from an efficiency and economy standpoint. For example, if the material need only be 90% dense rather than 95% dense, less pressure could be applied, resulting in energy savings.

Other potential applications for the refractory materials of this invention include abrasives, polishing powders, elements for resistance heating furnaces, shape-memory alloys, high temperature structural alloys, steel melting additives and electrodes for the electrolysis of corrosive media.

It is preferred that (if appropriate according to heat capacities of the product) any diluents that are to be plasma sprayed and combusted with the reactive exoergic materials according to this invention be pre-reacted components of the refractory product; that is, for example, if the desired product is a composite material comprising TiC ceramic grains in a NiAl matrix, that the diluent be either TiC and/or NiAl. Preferred diluents include TiC, $Ni_3Al$ and/or NiAl. Titanium boride and titanium diboride are not preferred diluents.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the preceding text and the following examples, all temperatures are set forth uncorrected in degrees Celsius and all parts and percentages are by weight, unless otherwise indicated.

EXAMPLE 1

An exoergic structure was formed using a conventional plasma spray gun. Argon gas was introduced into the plasma spray gun at the rate of 40 standard cubic feet/hour. A current of 600–800 amps was applied to the electrodes of the gun to form a plasma directed to, but not impinging upon, a substrate. Aluminum and $Fe_2O_3$ having a particle size between 270 mesh and 325 mesh were simultaneously introduced into the plasma feed gas at a gas flow rate of 10–45 standard cubic feet/hour. A shaped exoergic structure was formed on the substrate.

EXAMPLE 2

The procedure of Example 1 was carried out using helium as the plasma-forming gas which was fed into the plasma spray gun at a rate of 75–125 standard cubic feet/hour.

EXAMPLE 3

The procedure of Example 1 was followed. The substrate was a steel article and the exoergic material was sprayed onto a flat surface thereof. A second steel member was placed on top of the face of the first member on which the exoergic material was plasma-sprayed. The exoergic material was then ignited. A weld between the two steel members resulted.

EXAMPLE 4

An exoergic structure was formed essentially according to the procedures of Example 1 except that the reactants were titanium (Ti) and boron (B) in a stochiometric ratio of 1 to 2 respectively. The powders were plasma sprayed with the gun approximately 9 inches from the substrate. Also, the feed rate for the reactant powders was from about 20 to 30 grams per minute resulting in a deposition rate from about 10 to 15 grams per minute.

Figure 4:
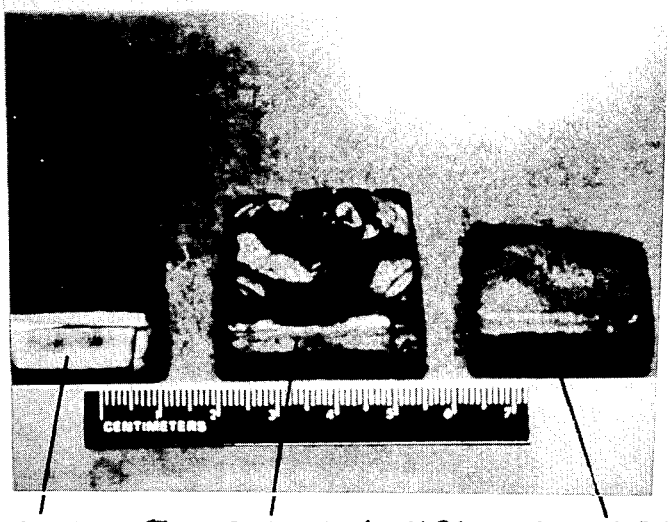
FIGS. 4–7 illustrate the refractory materials produced according to this invention and the varying densities achieved by plasma spraying the reactive exoergic materials and then igniting the plasma sprayed (unreacted) piece to initiate a combustion synthesis reaction either at 1 atmosphere (atm) or under an inert gas (argon) pressure of 1000 atm.

A shaped exoergic structure as shown in FIG. 4 (at left) was thereby formed. The density of said unreacted mixture of Ti and B was 98%.

Said structure was then ignited with a tungsten coil at 1 atmosphere (atm) of pressure under argon. The resulting combustion synthesis reaction produced a $TiB_2$ block as shown as the central piece of FIG. 4 having a density of 71%.

EXAMPLE 5

The procedures of Example 4 were followed except that the unreacted piece was placed in an autoclave wherein an argon gas pressure of 1000 atm was applied before and during ignition. The resulting $TiB_2$ piece is shown in FIG. 4 to have a density of 90%.

EXAMPLE 6

The procedures of Example 4 were essentially followed for this experiment wherein a composite material of a ceramic and metallic was formed. For this example, particulate iron (Fe) was combined with the titanium powder prior to plasma spraying wherein the Fe comprised approximately 2–5% of the mixture.

Figure 6:
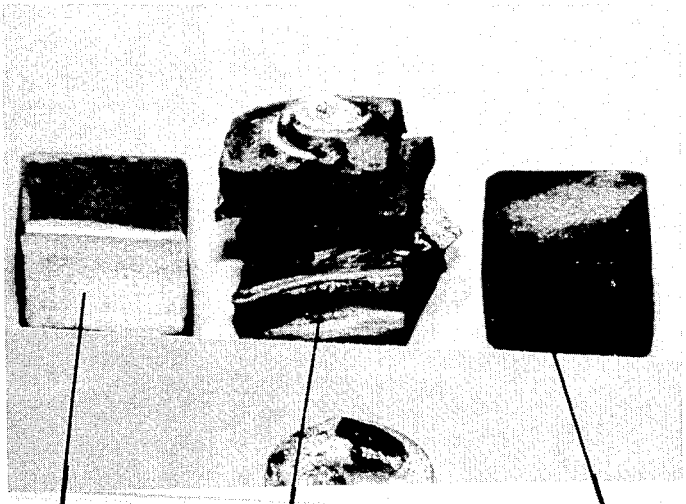
Figure 5:
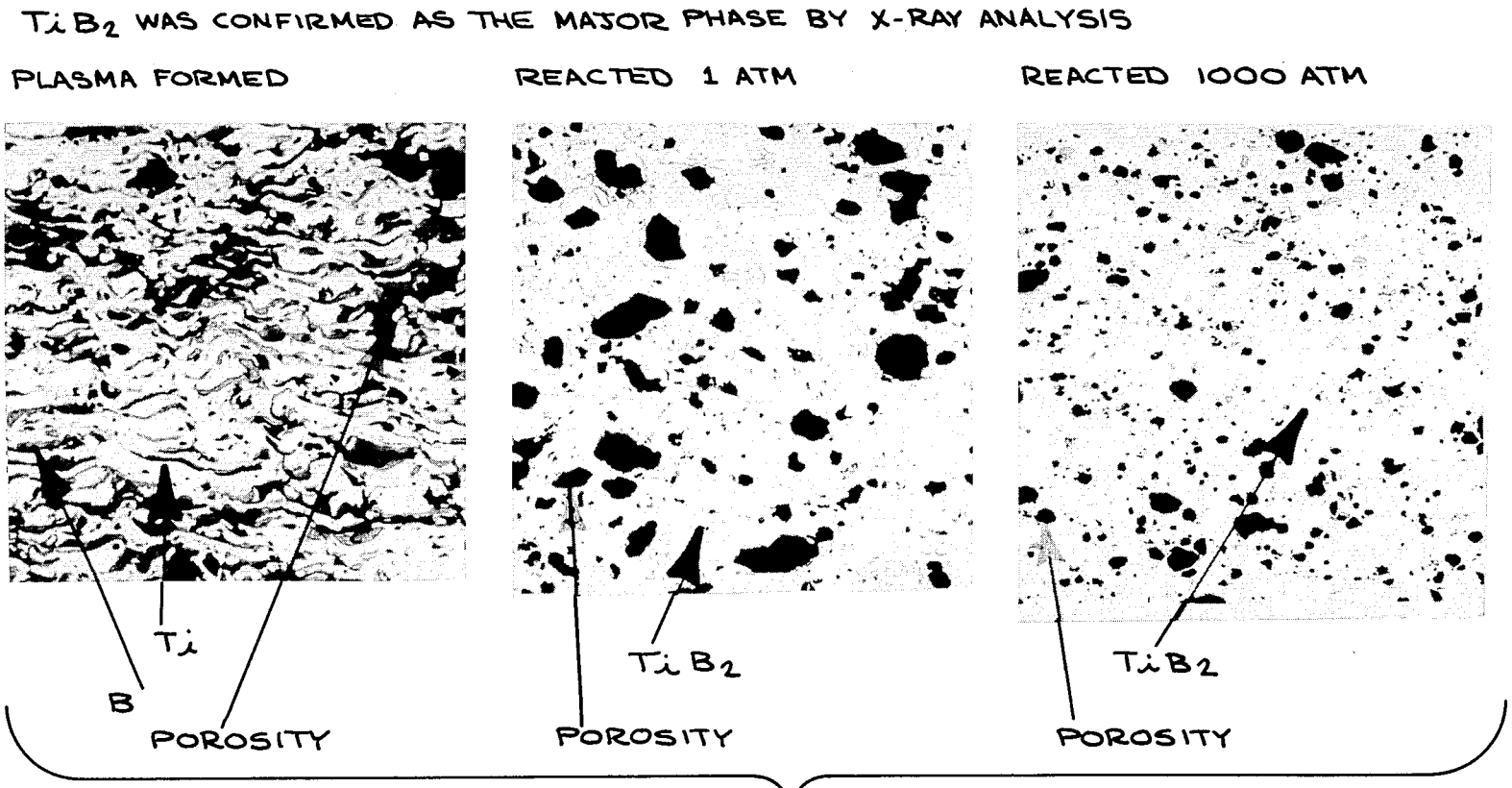
Figure 7:
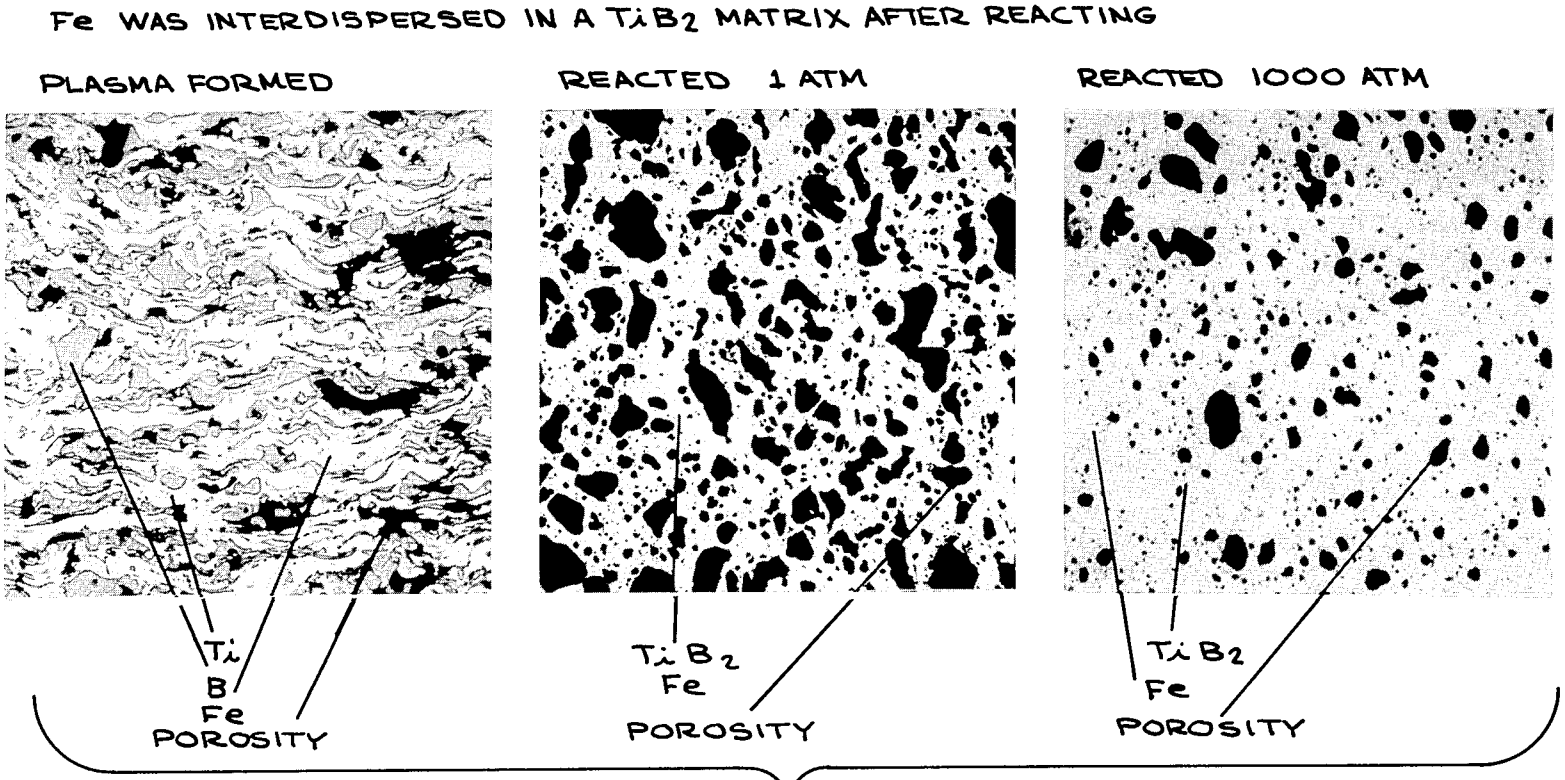

The resulting pieces are shown in FIG. 6 wherein the plasma sprayed, unreacted piece had a density of 90%; the composite material comprising $TiB_2$ and Fe that was combustion synthesized at 1 atm had a density of 62%; and the composite, combustion synthesized at 1000 atm, had a density of 84%.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

We claim:

1. A method of producing combustion synthesis products which comprises:

(a) introducing an oxygen-free plasma-forming gas into a plasma spray;

(b) introducing reactive exoergic materials capable of sustaining a combustion synthesis reaction in finely divided particulate form into said plasma spray directed toward, but not impinging on, a substrate;

(c) melting, without chemically reacting, said exoergic materials in the plasma;

(d) impinging said molten reactive exoergic material on said substrate; and (e) igniting said impinged exoergic materials.

2. A method according to claim 1 wherein said reactant exoergic materials are ignited under an inert gas pressure greater than 1 atmosphere (atm) and less than about 4000 atm.

3. A method according to claim 1 wherein the step of igniting the exoergic materials is under an inert gas pressure greater than 1 atm and less than about 4000 atm.

4. A method according to claim 1 wherein the combustion synthesis products are of near net or net shape and wherein said substrate comprises molds or flat surfaces of arbitrary shape.

5. A method according to claim 1 wherein the combustion synthesis products are dense refractory materials and the step of igniting the exoergic materials is under an inert gas pressure of from about 500 atm to about 4000 atm.

6. A method according to claim 5 wherein the inert gas pressure is from about 1000 atm to about 3000 atm.

7. A method according to claim 6 wherein the pressure is from about 1500 to about 2500 atm.

8. Dense refractory materials produced by the method of claim 5.

9. A method of producing dense refractory materials of arbitrary shape which comprises:

(a) introducing an oxygen-free plasma-forming gas into a plasma spray;

(b) introducing reactive exoergic materials capable of sustaining a combustion synthesis reaction in finely divided particulate form into said plasma spray directed toward, but not impinging on, a substrate consisting of molds or flat surfaces of arbitrary shape;

(c) melting, without chemically reacting, said exoergic materials in the plasma;

(d) impinging said molten reactive exoergic materials on said substrate; and (e) igniting said impinged exoergic materials under a pressure of from about 500 atm to about 4,000 atm.

10. A method according to claim 9 wherein the pressure is an inert gas pressure of from about 1000 to about 3000 atm.

11. A method according to claim 10 wherein the pressure is from about 1500 atm to about 2500 atm.

12. Dense refractory materials of arbitrary shape produced by the method of claim 9.

13. A dense refractory material according to claim 12 comprising one or more ceramic phases, an intermetallic or a composite material comprising a ceramic and intermetallic and/or metallic phases.

14. A dense refractory material according to claim 13 which is selected from the group consisting of AlCo, AlNi, $NbGe_2$, $Nb_5Ge_3$, $NbAl_3$, TiNi and $TiNi_2$.

15. A composite material according to claim 13 comprising $TiB_2$ and Fe.

16. A dense refractory material according to claim 12 which is a boride, a sulfide, a selenide, or a silicide.

17. A dense refractory material according to claim 16 which is a selenide selected from the group consisting of $WSe_2$, ZrSe, $MoSe_2$, $NbSe_2$, $TaSe_2$ and $TiSe_2$.

18. A dense refractory material according to claim 16 which is a sulfide selected from the group consisting of $WS_2$, MgS, $MoS_2$, $NbS_2$ and $TaS_2$.

19. A dense refractory material according to claim 16 which is silicide selected from the group consisting of CrSi, $Cr_5Si_3$, $WSi_2$, $W_5Si_3$, ZrSi, $ZrSi_2$, $MoSi_2$, $Mo_3Si$, $NbSi_2$, $TaSi_2$, TiSi, $TiSi_2$, $TiSi_3$ and $Ti_5Si_3$.

20. A boride according to claim 16 which is selected from the group consisting of aluminum, chromium, titanium, tantalum, hafnium, vanadium, magnesium, tungsten, zirconium, molybdenum and niobium borides.

21. A boride according to claim 20 which is selected from the group consisting of titanium, zirconium, hafnium and niobium borides.

22. A dense refractory material according to claim 20 which is a boride selected from the group consisting of $AlB_2$, CrB, $CrB_2$, VdB, $VdB_2$, $HfB_2$, WB, $WB_2$, $W_2B$, $W_2B_4$, $MgB_4$, $MgB_6$, ZrB, $ZrB_2$, MoB, $Mo_2B$, $Mo_2B_5$, NbB, $NbB_2$, TaB, TiB and $TiB_2$.

23. A dense refractory material according to claim 22 which is TiB or $TiB_2$.

* * * * *